US008664931B2

(12) United States Patent
Schneider et al.

(10) Patent No.: US 8,664,931 B2
(45) Date of Patent: Mar. 4, 2014

(54) SELF-OPTIMIZING ENERGY HARVESTER USING GENERATOR HAVING A VARIABLE SOURCE VOLTAGE

(75) Inventors: Leif E. Schneider, Albany, OR (US); Kevin D. Thompson, Salem, OR (US)

(73) Assignee: Perpetua Power Source Technologies, Inc., Corvallis, OR (US)

( * ) Notice: Subject to any disclaimer, the term of this patent is extended or adjusted under 35 U.S.C. 154(b) by 101 days.

(21) Appl. No.: 13/494,999

(22) Filed: Jun. 13, 2012

(65) Prior Publication Data

US 2012/0313612 A1 Dec. 13, 2012

Related U.S. Application Data

(60) Provisional application No. 61/520,705, filed on Jun. 13, 2011.

(51) Int. Cl.
*G05F 5/00* (2006.01)
*G05F 1/00* (2006.01)

(52) U.S. Cl.
USPC ..... 323/299; 323/224; 323/285

(58) Field of Classification Search
USPC ..... 323/222, 223, 224, 266, 282, 285, 298, 323/299, 311, 351, 901, 906; 136/205, 206
See application file for complete search history.

(56) References Cited

U.S. PATENT DOCUMENTS 6,111,391 A * 8/2000 Cullen ..... 323/223
6,163,141 A * 12/2000 Yoshida et al. ..... 323/284
6,204,645 B1 * 3/2001 Cullen ..... 323/223
6,958,443 B2 10/2005 Stark
7,629,531 B2 12/2009 Stark
2008/0047363 A1 * 2/2008 Arms et al. ..... 73/862
2009/0015216 A1 * 1/2009 Seberger et al. ..... 323/234
2009/0260668 A1 * 10/2009 Maeda ..... 136/205
2010/0139291 A1 6/2010 Hofmeister
2010/0270996 A1 * 10/2010 Ramadas et al. ..... 323/311
2011/0094556 A1 4/2011 Stark
2011/0260536 A1 * 10/2011 Roy et al. ..... 363/60

OTHER PUBLICATIONS

Linear Technology Corporation, "LTC3105 Specification", retrieved on May 30, 2012.
Marlow Industries, "Energy Harvesting for Wireless Sensors," retrieved on May 30, 2012.
Texas Instruments, "MSP430F Microcontroller Specification," retrieved on May 30, 2012.

* cited by examiner

*Primary Examiner* — Gary L Laxton
*Assistant Examiner* — Alex Torres-Rivera

(57) ABSTRACT

A self-optimizing energy harvester comprises a thermoelectric generator coupling to a thermal source, producing a source voltage greater than a minimum start-up voltage, where the thermoelectric generator drives a boost circuit and a feedforward circuit, delivering power to a load. A conventional boost circuit has a maximum output power only at the input voltage for which a fixed set point resistor is chosen. The feedforward circuit dynamically optimizes the boost circuit according to a dynamic set point resistance, thus increasing output power for a wide range of input voltages, relative to using a fixed reference resistor. The dynamic set point resistance is the sum of a variable resistance and a reference resistance. A sample element forms a differential voltage between the source and input voltage elements, and the variable resistance corresponds to the differential voltage. A reference resistor is chosen to establish the minimum start-up voltage.

31 Claims, 9 Drawing Sheets

Analog Feed Forward # 1

Analog Feed Forward # 2

MicroController Feed Forward #1

MicroController Feed Forward #2

MicroController Feed Forward #3

Power Transfer Algorithm

SELF-OPTIMIZING ENERGY HARVESTER USING GENERATOR HAVING A VARIABLE SOURCE VOLTAGE

CROSS-REFERENCE TO RELATED APPLICATIONS

This application claims priority from U.S. Provisional Application No. 61/520,705, filed Jun. 13, 2011, entitled "Self-Optimizing Dc-Dc Conversion Circuit for Energy Harvesting Applications", the entire contents of which are incorporated herein by reference.

FIELD

The present disclosure relates to the field of energy harvesters which may supply electrical power to wireless sensors and other loads.

BACKGROUND

Energy harvesters have long been used to extract energy from the local environment, as in the case of windmills and water turbines, and convert it to mechanical or electrical power. Modern micro-energy harvesters convert heat, sunlight, radio frequency energy, or vibration into electricity via thermoelectric generators (TEGs), photovoltaic panels, radio frequency (RF) harvesters, or piezoelectric generators, respectively. Power levels ranging from microwatts to hundreds of milliwatts are harvested by the generator within the micro-energy harvester and then converted by a DC-DC voltage converter into a load voltage. Since the arrival of digital integrated circuits, electronic products that can operate from decreasing amounts of energy have proliferated, among them wireless sensors. Wireless sensors have become useful in the fields of personal health, wilderness, and industrial monitoring, and micro-energy harvesters are a natural solution to these new applications. Because energy harvesters can supply power indefinitely, and can be placed in remote or wilderness locations, reliability and longevity have become critical requirements. Energy harvesters may also be used inside buildings where electricity is available, but economic, mobility, and other advantages make energy harvesters a preferred source of electrical power. Unfortunately, peak power is not always available, such as when clouds reduce the irradiance of a solar cell, or when a hot pipe being tapped by a TEG becomes cool. To alleviate environmental variability, storage elements such as capacitors and batteries are often employed to store some of the harvested energy and supplement the harvester during off-peak times. Unfortunately, storage elements may be bulky, expensive, and require periodic maintenance.

Addressing the drawbacks associated with storage elements, more efficient DC-DC converters based on FET switching technologies became available in the 1980s, expanding the applicability of micro-energy harvesters and reducing the need for storage elements. Switching DC-DC converters eliminate heavy transformers and reduce the need for linear voltage regulators, creating a smaller, lighter package and harvesting more power. Inductors and capacitors are used as charge elements, transferring power from the generator to the load through low-loss transistors switched at an appropriate frequency and duty cycle. The size of the charge element(s), duty cycle, and switching frequency determine the input voltage required of the generator for a desired converter output voltage. Once these circuit values are chosen, output power efficiencies of 80-95% may be achieved. Output power efficiency may be defined as the ratio of the output power to the input power. However, efficiencies drop sharply if the generator source voltage varies from the input voltage for which the converter was designed, resulting in lower output power. Additionally, each converter may have a minimum start-up voltage below which the input voltage is insufficient to charge the converter into steady state operation. Unfortunately, a fixed DC-DC converter is limited to delivering high power efficiencies only over a relatively narrow range and must therefore be customized for each generator's source voltage.

Further complicating the challenge of operating a DC-DC converter over a wide range of source voltages, consider the thermoelectric generator (TEG). TEGs extract power from a heat flow caused by a temperature difference, abbreviated as $\Delta T$, established between a heat source and a heat sink. The source voltage is approximately proportional to the $\Delta T$. TEGs commonly operate from $\Delta T$s as little as 5 K to 100 K or more, producing source voltages from millivolts to volts. A TEG source voltage may vary over a 10:1 range or more, depending on the intensity of the heat source, whereas a photovoltaic generator has a relatively stable output voltage—its current varying with solar irradiance. Additionally, as $\Delta T$ increases, source voltage increases and source impedance may vary. The variation in source impedance explains another cause of converter inefficiency. One possible solution to maintain maximum power transfer is to change the converter input impedance to match the source impedance. Maximum power transfer occurs when the load impedance of the DC-DC converter equals the source impedance of the generator. Under maximum power transfer conditions, the open circuit source voltage is divided equally between the internal source impedance and the converter's load impedance. In conclusion, conventional DC-DC converters are efficient over a narrow range of input voltages, and a TEG has a particularly wide range of source voltages and, additionally, a shifting source impedance. Thus, what is needed is an improved voltage converter that can accommodate a wide range of input voltages and a shifting source impedance.

In order to align a converter to a generator's source voltage, manufacturers provide designs which allow the customer to choose certain element values that are external to the semiconductor package. For example, referring to FIG. 1, one converter, designated as the LTC3105 contains a boost circuit to step up the voltage, and is generally intended for photovoltaic applications. L1 may be chosen to be between 4.7 μH (micro-henrys) and 30 μH, with a nominal recommended value of 10 μH, depending on the expected source voltage.

For a very low input voltage, a larger L1 value provides higher efficiency and a lower start-up voltage than if the nominal value for L1 is used. The input voltages for which efficiency is >80% ranges from about 0.9 V (volts) to about 2.8 V, or about 3:1, as shown in the graph of FIG. 2. Also, the graph of FIG. 2 indicates that the start-up voltage is about 0.6 V, and then efficiency climbs quickly as input voltage rises, leveling off in the 80-90% range, then dropping off. The choice of external charge element values allows a generator to be nominally matched to a converter. However, the range of generator source voltages over which efficiency is high is still limited, for example, to about 3:1, in the case of the LT'C3105 shown in FIG. 1. For a TEG with a 10:1 range of source voltage, the LTC3105 may have too narrow of an operating range, losing much of the power that could have been harvested.

In order to improve the matching of generator source voltage to a compatible DC-DC converter, having already optimized external component values, some converters provide an adjustable start-up voltage settable by a reference resistor, shown as $R_{MPPC}$ in FIG. 1. In this example, a control circuit called the MPPC (maximum power point control) circuit regulates the average inductor (L1) current within the boost circuit in order to configure the input impedance and start-up voltage of the converter. For example, the start-up voltage can be set to as low as 0.25 V by setting $R_{MPPC}$ to 22 kΩ. Unfortunately, setting the minimum start-up voltage to 0.25 V, in the case of the LTC3105, results in virtually no increase in boost circuit output power as input voltages become several times the minimum start-up voltage resulting in poor efficiency at input voltages greater than the turn on voltage. What is needed is a method of establishing a low start-up voltage to capture the low end of a TEGs operating range, and then extend the operating range to well above the start-up voltage.

An additional problem is the case where the input voltage momentarily exceeds the start-up voltage and then drops below it before the boost circuit has been charged enough to generate the regulated power supplies that power its internal circuitry. If a load, such as a wireless sensor, is connected directly to the boost circuit, it may begin to drain off some of the input energy being used to charge up the boost circuit and thereby sabotage the start-up process, thus delaying the start-up process. Also, if the input voltage drops below the start-up voltage after steady state operation has been established, the load may fully discharge the boost circuit unnecessarily. What is needed is a method of isolating the load from the boost circuit during positive and momentary negative excursions of input voltage occurring across the start-up voltage threshold.

Another solution to environmental variability in harvested power is to combine two or more complementary generators whose off-peak output conditions occur at different times of the day. For instance, a TEG and a photovoltaic cell could be combined to make a more reliable harvester, thus requiring a smaller storage element. In this case, it is desirable for both generators to use the same voltage converter in order to save cost and reduce bulk. However, a photovoltaic cell tends to have a different source voltage than a TEG, thus compounding the problem of DC-DC converters not accommodating a wide enough range of input voltages. However, if one generator could set a boost circuit operating point ideal for its source voltage when it was dominant, and the other generator could set a boost circuit operating point ideal for its source voltage when its dominant, a more compact and reliable energy harvester could be achieved.

One option is to apply microprocessors or digital microcontrollers to the voltage converter in an attempt to optimize its operation through programmed values of operating points, or through switching in and out different components for different operating points. However, the micro-energy harvester is operating in a frugal and small-footprint environment, sometimes operating at far below 100 μW of power, and may require very judicious application of additional power drain for a microprocessor and switching circuitry.

As can be seen, there exists a need in the art for a system and method of dynamically adjusting the set point of a boost circuit according to the instantaneous input voltage such that high output power efficiency may be achieved over a relatively large range of input voltages. Additionally, there exists a need in the art for a system and method of matching the varying source impedance of a TEG to the boost circuit such that maximum power transfer may occur. Furthermore, there exists a need in the art for a system and method of isolating the boost circuit from the load during positive and momentary negative excursions of input voltage around the start-up voltage. Ideally, the system and method require minimal power, are relatively inexpensive, and are easily implemented in a DC-DC converter.

SUMMARY

The above-described needs associated with energy harvesters are specifically addressed and alleviated by the present disclosure which, in an embodiment, provides a self-optimizing energy harvester that may comprise a thermoelectric generator that may be coupled to a temperature difference for providing heat flow through the thermoelectric generator. The thermoelectric generator may produce a source voltage that may be greater than a minimum start-up voltage and which drives a boost circuit, delivering power to a load at a voltage higher than the input voltage. A conventional boost circuit may have a maximum output power only at the input voltage for which a fixed set point resistor is chosen. The energy harvester may include a feedforward circuit that may dynamically optimize the boost circuit according to a dynamic set point resistance, thus instantaneously increasing output power for a wide range of input voltages, relative to using a fixed reference resistor. The dynamic set point resistance is the sum of a variable resistance and a reference resistance. A sample element may form a differential voltage between the source and input voltages, and may be proportional to the variable resistance. A reference resistor may be chosen to establish the minimum start-up voltage.

In an embodiment, a resistor divider feeds fractional samples of the source voltage from a thermoelectric generator having a source impedance to a microcontroller input. A switch normally connecting the source voltage to a boost circuit having an input impedance is periodically disconnected momentarily by the microcontroller, thereby alternately generating an open circuit voltage and a source voltage presented to the microcontroller input and indicative of a mismatch that may exist between the source impedance of the thermoelectric generator and the input impedance of the boost converter. The voltage ratio of the open circuit voltage to the source voltage may be made substantially proportional to a gate voltage produced by the microcontroller and may be applied to a voltage controlled resistor. A reference resistor connecting in series with the voltage controlled resistor may form a dynamic set point resistance electrically grounded at one end, the dynamic set point resistance having an off-state resistance establishing a minimum start-up voltage at which the converter turns on. The set point control circuit increases the power transfer from the thermoelectric source to the boost circuit for each occurring input impedance and source impedance by configuring the boost circuit according to the dynamic set point resistance, relative to using a fixed resistance.

In another embodiment, the differential voltage, being a sample of the thermoelectric generator source voltage, may be applied to an amplifier, generating a gate voltage which may be applied to a voltage controlled resistor. A reference resistor connecting in series with the voltage controlled resistor may form a dynamic set point resistance electrically grounded at one end, the dynamic set point resistance having an off-state resistance establishing a minimum start-up voltage at which the converter turns on.

In another embodiment, a thermoelectric generator having a power drift over a period of time may deliver a source voltage to a sampling resistor attenuating said source voltage and leaving an input voltage. A differential amplifier receiving said source voltage and said input voltage and amplifying a resulting differential voltage may generate a buffered output which is proportional to an input current calculated by dividing the differential voltage by the sampling resistor. A resistive divider conducting the input voltage to ground may provide a fractional voltage proportional to the input voltage at a junction between a first resistance and a second resistance summing to form the resistive divider. A voltage controlled resistor having a gate terminal may be connected in series with a reference resistor, forming a dynamic set point resistance electrically grounded at one end, the dynamic set point resistance having an off-state resistance establishing a minimum start-up voltage for a boost converter. A microcontroller may couple to the gate terminal of the voltage controlled resistor and may calculate an input power during the period of time over which power drift occurs, the input power being substantially proportional to the product of a sample of the input voltage and a sample of the input current, the period of time comprising a dwell interval and a sleep interval, the microcontroller drawing substantially lower current during the sleep interval occupying a substantial majority of the period of time. The microcontroller may perform the following during the dwell interval: measuring the input power for an existing value of the dynamic set point resistance, calculating a power change by subtracting an input power for a preceding value of the dynamic set point resistance from an input power for the existing value of the dynamic set point resistance, and iterating the dynamic set point resistance by an amount substantially causing an increase in the input power during the dwell interval, wherein the increase in the input power may be substantially equal to the power drift occurring in the thermoelectric generator over the period of time. A boost circuit coupling to the input voltage larger than the minimum start-up voltage and generating an output voltage generally larger than the input voltage may have an input impedance according to the minimum start-up voltage for which it is configured. A set point control means may be coupled to the boost circuit and to the dynamic set point resistance, the set point control means continuously configuring the boost circuit for increasing input power from the thermoelectric generator and into the boost circuit for each occurring dwell interval by using the dynamic set point resistance relative to using a fixed resistance, the boost circuit delivering an output power to the load.

Also disclosed herein is a method for harvesting thermoelectric energy and supplying a load. The method may include the step of coupling a temperature difference, composed of a heat source and a heat sink, to a thermoelectric generator. The method may include the steps of converting heat flow due to the temperature difference into a source voltage, and attenuating the source voltage to produce an input voltage which is at least 80% of the source voltage. In addition, the method may include subtracting the input voltage from the source voltage to produce a differential voltage. The method may further include processing the differential voltage and generating a variable resistance and a reference resistance summing to form a dynamic set point resistance. The variable resistance may be proportional to the differential voltage, and the reference resistance setting a minimum start-up voltage, the step of processing may require performing at least one of the following: buffering, amplifying, level shifting, digitizing, storing, and analog recovering. The method may additionally include the steps of boosting the input voltage larger than the minimum start-up voltage and generating an output voltage larger than the input voltage, and maximizing output power only at the input voltage for which it is configured. In addition, the method may include configuring the output power at each occurring input voltage larger than the minimum start-up voltage and according to the dynamic set point resistance to thereby increase the output power for a range of input voltages by using a dynamic set point resistance relative to using a fixed resistance.

BRIEF DESCRIPTION OF THE DRAWINGS

To further clarify the above and other advantages and features of the present disclosure, a more particular description of the disclosure is rendered by reference to specific embodiments thereof which are illustrated in the appended drawings. It is appreciated that these drawings depict only typical embodiments of the disclosure and are therefore not to be considered limiting of its scope. The disclosure is described and explained with additional specificity and detail through the use of the accompanying drawings in which.

DETAILED DESCRIPTION

Figure 3:
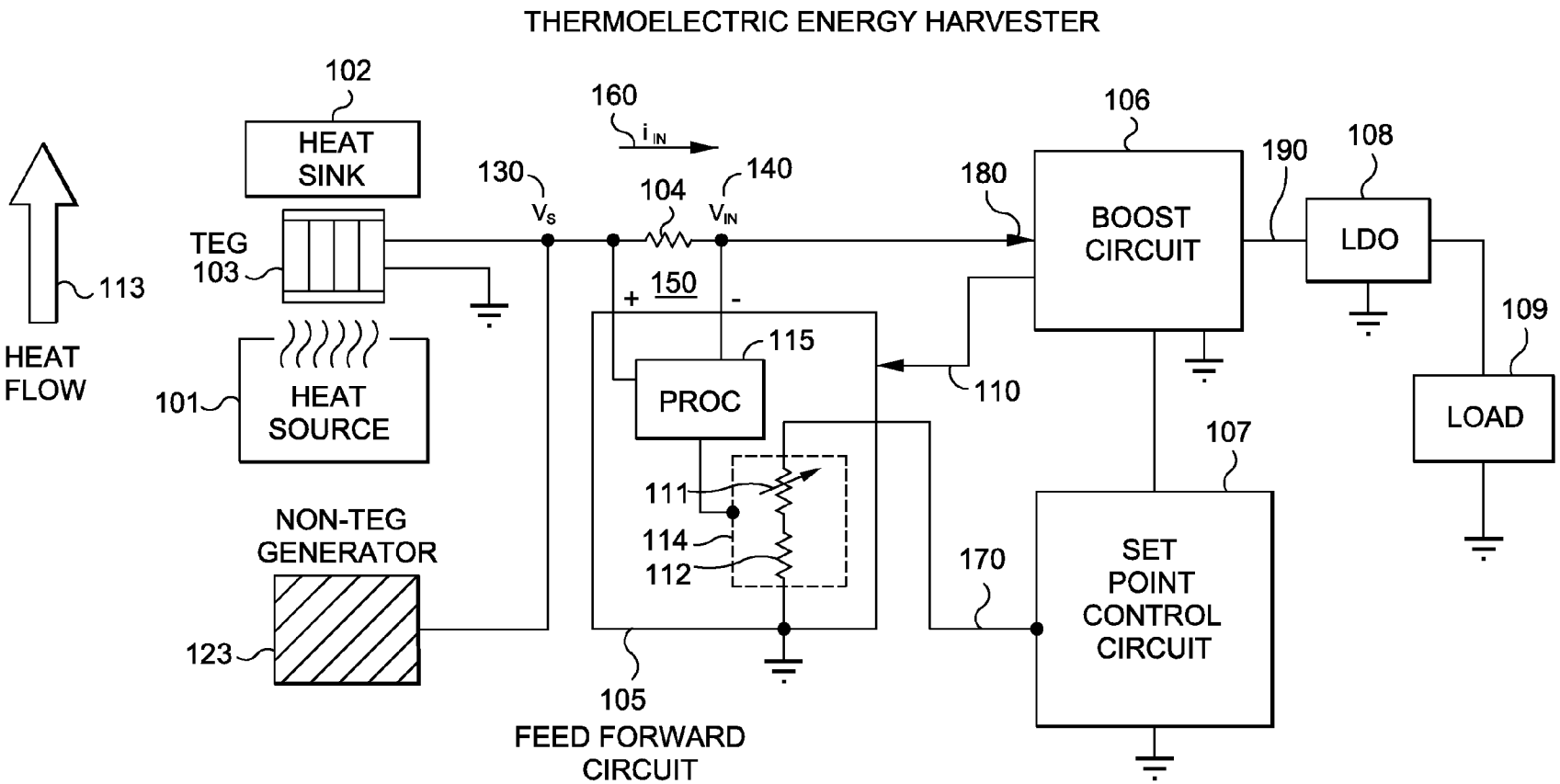
FIG. 3 is a block diagram of an embodiment of a thermoelectric energy harvester as disclosed herein.

Referring now to the drawings wherein the showings are for purposes of illustrating preferred and various embodiments of the disclosure, shown in FIG. 3 is an embodiment of a thermoelectric energy harvester. A thermoelectric generator (TEG) 103 may be thermally coupled to a heat source 101 and to a heat sink 102, creating a heat flow 113 through the TEG. The TEG 103 is preferably composed of any number of thermocouples of dissimilar conductors, and generates an electrical source voltage 130 approximately proportional to the temperature difference $\Delta T$ between the heat source 101 and heat sink 102 sides as measured at the corresponding TEG 103 mounting surfaces. Optionally, complementary generator 123 of a non-thermoelectric type may be coupled alone or in parallel with TEG 103 in order to provide diversity, thereby enhancing power availability. Both generators 103, 123 may take advantage of this micro-energy harvester configuration, and the complimentary generator 123 may include piezoelectric, RF harvesting, photovoltaic, and other generator types.

Source voltage 130 may be split into a boost path and a feedforward path. Sampling resistor 104 slightly attenuates the source voltage 130 to produce input voltage 140 and input current 160. Differential voltage 150 is source voltage 130 minus input voltage 140, and input current 160 is calculated as differential voltage 150 divided by resistance 104. The input voltage 140 divided by input current 160 may provide the feedforward circuit with a measure of the input impedance of boost circuit 106. And input voltage 140 times input current 160 provides the feedforward circuit with a measure of power transferred to boost circuit 106. Preferably, sampling resistor 104 is a value much smaller than the input impedance of boost circuit 106 so that the input voltage 140 is at least 80% of the source voltage 130. However, larger values for sampling resistor 104 may be necessary if a larger differential voltage 150 is necessary for stable and reliable operation. Typically, the input impedance of a boost circuit 106 is several ohms, but may vary widely depending on input voltage 140 and output voltage 190.

Continuing with FIG. 3, the following is a description of feedforward circuit 105, whose purpose is to dynamically modify the operating point of boost circuit 106 in order to increase the output power delivered to load 109 over a wide range of source voltages 130, relative to the output power achieved without a feedforward circuit. The present disclosure adds a feedforward circuit to a conventional voltage converter composed of a boost circuit and a set point control circuit. During the initial stages of operation, feedforward processor 115 preferably processes differential voltage 150 to generate a variable resistance 111 and a reference resistance 112 which are summed to form a dynamic set point resistance 114. Feedforward processing preferably includes buffering, amplifying, and level shifting, but may also include digitization, data storage, and analog recovery. Variable resistance 111 is substantially proportional to differential voltage 150, and reference resistance 112 is chosen to set a minimum start-up voltage occurring at the input 180 of the boost circuit 106. The dynamic set point resistance 114 is at a minimum value when the regulated supply voltage 110 is unpowered, and this condition sets the minimum start-up voltage at input 180. The unpowered state occurs when input voltage 140 has yet to exceed the minimum start-up voltage required by boost circuit 106 to collect enough energy with which to provide a regulated supply voltage 110 to the feedforward circuitry.

Continuing with the description of the energy harvester in FIG. 3, dynamic set point resistance 114 is applied to the set point input 170 where a conventional voltage converter would have a static resistor value for establishing a minimum start-up voltage. The set point control circuit 107 performs functions as necessary to optimize the operating point of boost circuit 106 for higher output power. These control functions generally include modifying the input impedance of boost circuit 106 by modulating charge currents, switching frequency, switching duty cycle, and/or other internal adjustments adjustable within the boost circuit 106 for optimizing its boosting function. By dynamically varying the set point input according to differential voltage 150, a higher output power is obtained from boost circuit 106 than would be by applying a static resistor value per the design of set point control circuit 107.

Figure 1:
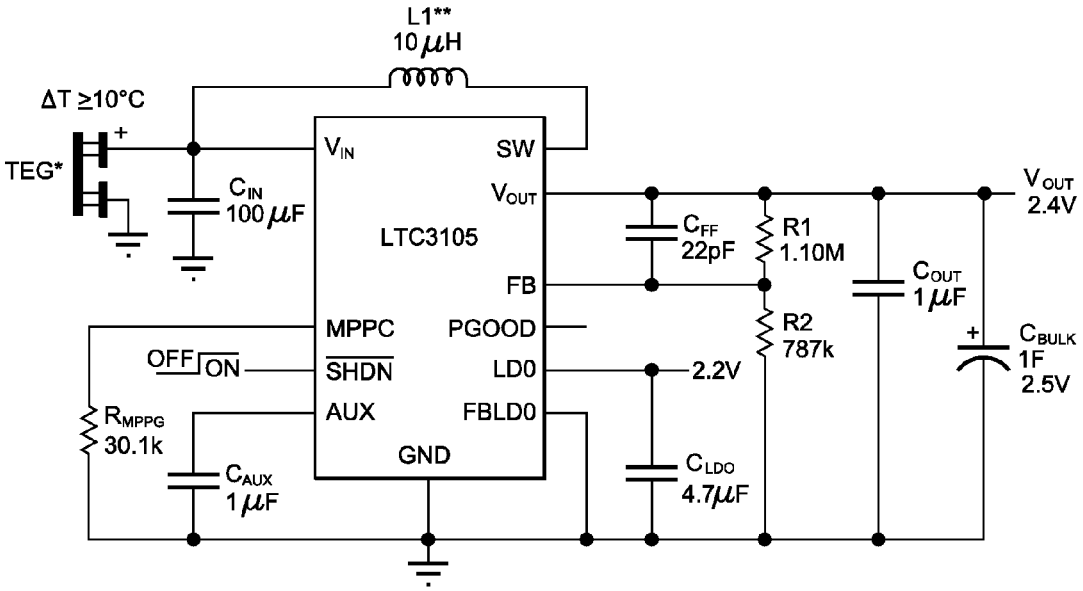
FIG. 1 (PRIOR ART)
FIG. 1 is a schematic diagram of a prior art DC-DC conversion circuit.
Figure 2:
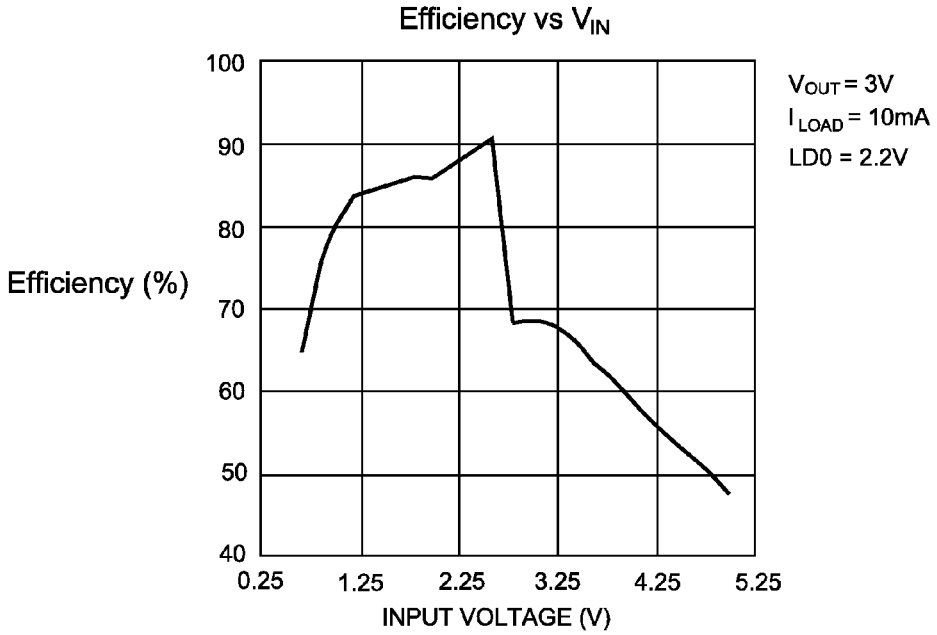
FIG. 2 (PRIOR ART)
FIG. 2 is a graph of DC-DC boost conversion efficiency in dependence of input voltage for a DC-DC conversion circuit illustrated in FIG. 1.

For an example of a conventional voltage converter, referring briefly to FIG. 1, the LTC3105 voltage converter contains essentially a boost circuit and a set point control circuit. A maximum power point control circuit (MPPC) settable by an MPPC resistor at its MPPC pin, the equivalent of set point input 170, is chosen to start-up the voltage converter at the lowest usable source voltage of the thermoelectric generator. The MPPC circuit then regulates the average inductor current (L1) according to the MPPC resistor value, which sets the minimum start-up voltage and input impedance of the boost circuit to match the source impedance and source voltage expected from the thermoelectric generator. This set point then provides a maximum output power beginning at the lowest usable generator source voltage and extending to moderately higher voltages. A typical 3:1 range of input voltages is depicted having output efficiency greater than 80%, in FIG. 2, by using a static MPPC resistor. Unfortunately, the chosen MPPC set point may be higher than minimum start-up voltage allowed by the boost circuit, but may have been chosen to make sure greater output power was extracted from the thermoelectric generator at higher source voltages, resulting in lost power opportunities. Additionally, since the LTC3105 is optimized according to one low source voltage, source voltages that span a large range, e.g. 10:1, will not be converted efficiently.

Advantageously, by adding a feedforward circuit 105 to the thermoelectric energy harvester, dynamic set point resistance can be set at the lowest minimum start-up voltage allowed by the LTC3105, efficiently retrieving low-level power from the TEG. Furthermore, as the TEG source voltage continues to increase, the operating point shifts up to re-optimize output power according to the source voltage.

The turn-on sequence of the feedforward circuit 105 is as follows. Once TEG 103 is generating enough power that input voltage 140 exceeds the minimum start-up voltage, boost circuit 106 begins to charge up and eventually can supply a regulated supply voltage 110 to feedforward circuit 105, in addition to supplying circuitry internal to boost circuit 106 and set point control circuit 107. As input voltage rises above the minimum start-up voltage, feedforward processor 115 increases the resistance presented to set point input 170 substantially proportional to differential voltage 150, thus shifting upwards the operating point of boost circuit 106 and maximizing output power to load 109 as if the minimum start-up voltage were originally set higher.

Although differential voltage 150 is chosen in this embodiment to establish a substantially linear proportionality to variable resistance 111, it is to be understood that other sample signals may be beneficially used. For example, combinations of source voltage 130, differential voltage 150, input voltage 140, and input current 160 may be fed forward by feedforward processor 115 to produce a dynamic set point resistance 114 that dynamically maximizes the output power delivered to load 109 over a wide range of input voltages.

Additional to setting a proportionality between variable resistance 111 and a sample signal, the power transferred to boost circuit 106 (input voltage 140 times input current 160) may be calculated from the sampled signals and then the dynamic set point resistance iterated until the power transferred to boost circuit 106 is maximized.

Although a linear transformation of differential voltage 150 is presented herein, it is to be understood that some applications of a thermoelectric energy harvester may require a proportionality having two or more piecewise linear slopes, or even have a non-linear transformation of the differential voltage, in order to compensate for the complex efficiency characteristics of boost circuit 106 occurring at different input voltages. Also, it is to be understood that a dynamic set point voltage may be applied to set point input 170 instead of a dynamic set point resistance 114, for applications where the set point control circuit 107 benefits from a voltage input instead of a resistive input. In this case, feedforward processor 115 generates a voltage substantially proportional to differential voltage 150.

Output voltage 190 delivers output power to an optional low drop out voltage regulator 108 for the purpose of providing a stable output voltage for load 109 after the boost circuit has been fully charged up and turned on.

Figure 4:
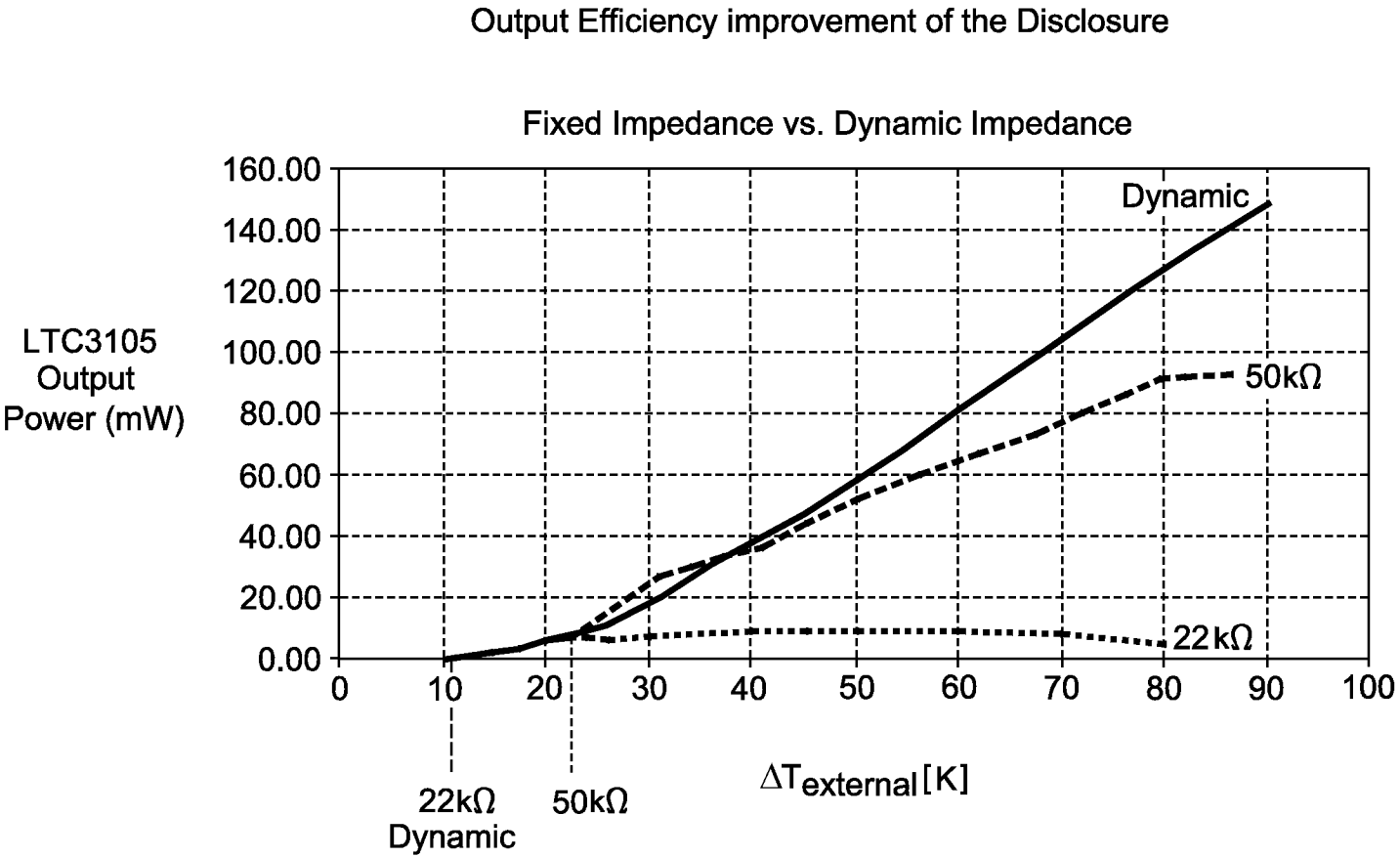
FIG. 4 is a graph illustrating the improved output power efficiency of the thermoelectric energy harvester disclosed herein.

Referring to FIG. 4, the output power of the LTC3105 boost converter is shown with fixed and dynamic impedances for the MPPC resistor at the set point input, and using a linear feedforward means described in this disclosure. A thermoelectric generator is the source. Conforming with standard measurement procedures, the X-axis represents $\Delta T_{external}$ which may be defined as the temperature difference between the heat source and the ambient air and which may range from 10 K to 100 K. Dividing $\Delta T_{external}$ by a factor of two produces an approximate scaling to $\Delta T$. $\Delta T$ may be defined as the temperature difference between heat source and heat sink. The Y-axis represents the output power in milliwatts (mW) delivered by the LTC3105 boost converter into a load. Since source voltage is substantially proportional to $\Delta T_{external}$, the X-axis also represents the source voltage available under matched impedance conditions. Note that the term impedance and resistance are substantially interchangeable, except that the boost circuit may under certain circumstance contain a reactive in addition to a resistive component. For the purposes of this discussion, we will assume that impedance is purely resistive. Numerical results are in the following Table 1:

TABLE 1

| $R_{MPPC}$ | Start-up $\Delta T_{external}$ | Output Power at $\Delta T_{external}$ = 80K | Roll-off $\Delta T_{external}$ |
|---|---|---|---|
| 22 KΩ | 10K | 5 mW | 45K |
| 50 KΩ | 22K | 90 mW | 80K |
| Dynamic | 10K | 125 mW | >90K |

As shown in Table 1, and referring to FIG. 3 and FIG. 4, the use of a dynamic set point resistance 114 proportional to the differential voltage 150 produces continuously increasing output slope from a $\Delta T_{external}$ of 10 K to at least 90 K, resulting in at least a 9:1 range of source voltage. In comparison, a resistor value of 22 kΩ produces a positive slope for a $\Delta T_{external}$ of 10-45 K, and a resistor value of 50 kΩ produces a positive slope of 22-80 K, for an approximately 4:1 slope of source voltage. "Roll-off $\Delta T_{external}$" may be defined as a transition point between a rising, positive slope and a subsequent reduced slope and/or a negative slope. Additionally, the power efficiency at the Roll-off $\Delta T_{external}$ is far less than 80%, so that the operating range may be far less than 4:1 using a fixed resistor value. In contrast, the dynamic impedance case shows self-optimization continuously across all values of $\Delta T_{external}$.

Figure 5:
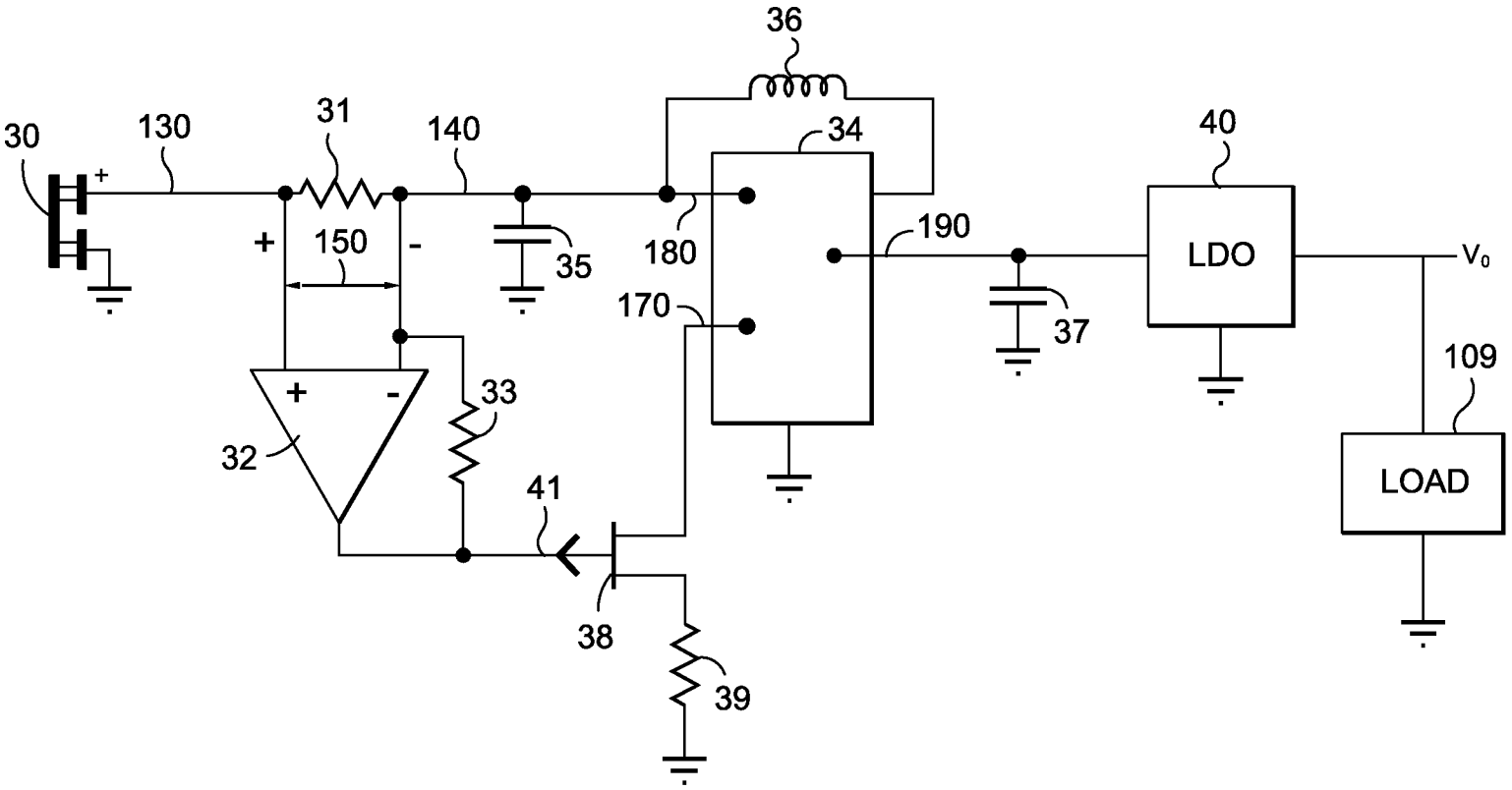
FIG. 5 is a schematic of a first analog embodiment of a feedforward circuit.

Referring to FIG. 5, a first low cost analog implementation of feedforward means is shown. Thermoelectric generator (TEG) 30 delivers a source voltage 130 to sampling resistor 31, producing input voltage 140, and generating differential voltage 150 between the positive and negative pins of a non-inverting operational amplifier 32. Preferably, sampling resistor 31 is a value much smaller than the input impedance of boost converter 34 so that the input voltage 140 is at least 80% of the source voltage 130. However, larger values for sampling resistor 31 may be necessary if a larger differential voltage 150 is necessary for stable and reliable operation. Capacitor 35 provides input filtering. Non-inverting operational amplifier 32 amplifies differential voltage 150 by a gain value set by feedback resistor 33 to produce a gate voltage 41. A p-channel JFET 38 acts as a voltage controlled resistor, controlled by gate voltage 41, establishing a variable resistance substantially proportional to differential voltage 150. Reference resistor 39 sums with the JFET variable resistance to form a dynamic set point resistance applied to set point input 170.

Boost converter 34 increases input voltage 140 greater than the minimum start-up voltage to an output voltage 190 greater than the input voltage 140, employing external charge inductor 36 and output filter capacitor 37. Set point control circuitry within the boost converter 34 applies the dynamic set point resistance occurring at set point input 170, increasing output power instantaneously according the input voltage, relative to the case where the set point resistance is a fixed value. In the unpowered state, the channel resistance of JFET 38 will be much less than reference resistor 39, and thus, reference resistor 39 will establish the minimum start-up voltage for the boost converter 34, and is chosen to either be the smallest operable value for the boost converter 34, or the smallest usable source voltage desired for the TEG, whichever is greater. Output voltage 190 delivers output power to a low drop out voltage regulator 40 for the purpose of providing a stable output voltage for load 109 after the boost circuit has been fully charged up and turned on.

The above disclosure regarding the first analog implementation of the feedforward means provides a simple, low-cost analog solution that may be easily integrated into a voltage converter and requiring no programming steps. The results of FIG. 4 show the substantial benefit provided by implementing the first analog version of the feedforward converter.

Figure 6:
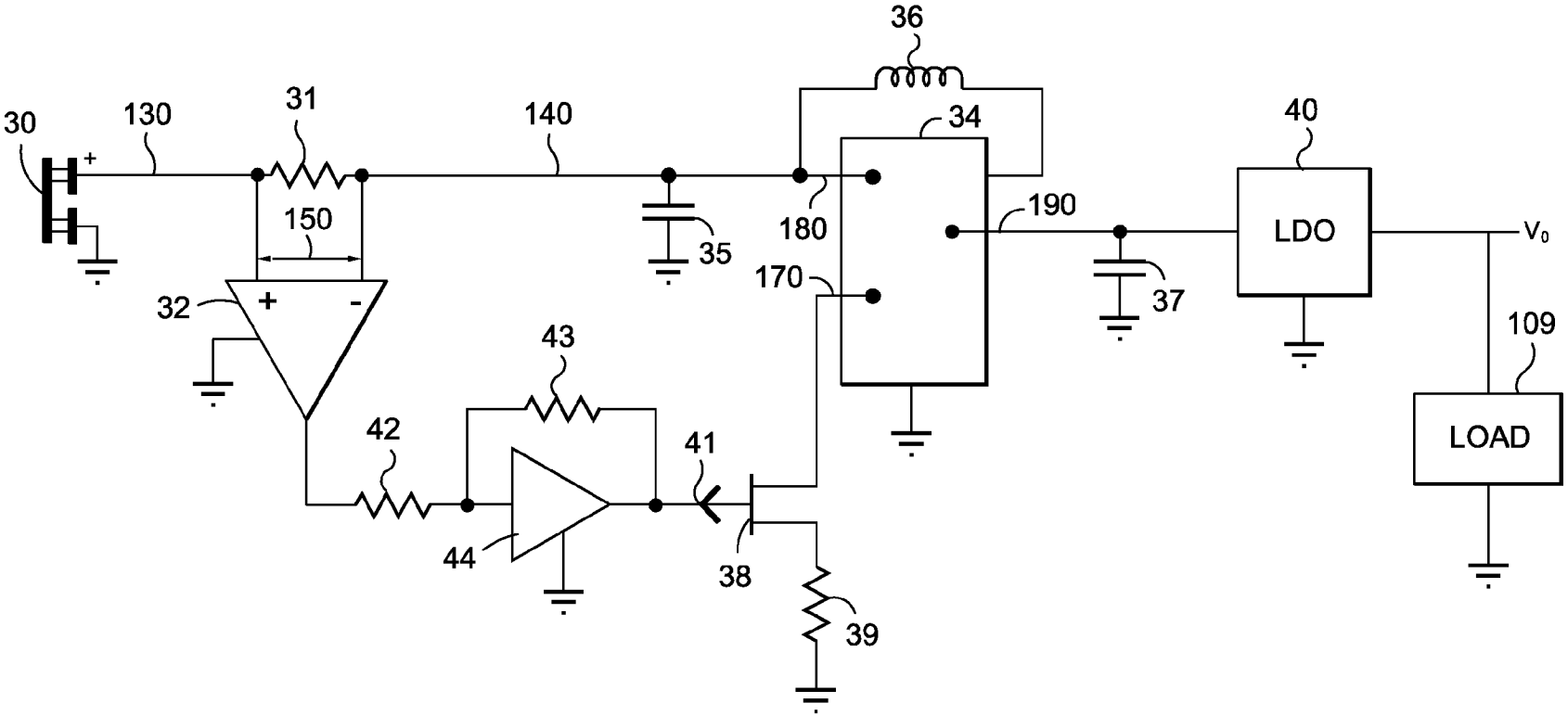
FIG. 6 is a schematic of a second analog embodiment of a feedforward circuit.

Referring to FIG. 6, a second low cost analog implementation of feedforward means is shown for the case where additional feedforward stability is necessary. Thermoelectric generator (TEG) 30 delivers a source voltage 130 to sampling resistor 31, producing input voltage 140, and generating differential voltage 150 between the positive and negative pins of a non-inverting operational amplifier 32. Preferably, sampling resistor 31 is a value much smaller than the input impedance of boost converter 34 so that the input voltage 140 is at least 80% of the source voltage 130. However, larger values for sampling resistor 31 may be necessary if a larger differential voltage 150 is necessary for stable and reliable operation. Capacitor 35 provides input filtering.

In FIG. 6, first amplifier 32 amplifies differential voltage 150, followed by a second amplifier 44 having input resistor 42 and feedback resistor 43, producing a gate voltage 41. The composite gain of amplifier 32 and amplifier 44 are divided between the two amplifies in order to provide stability in gain and in offset voltage, preferably yielding a gain variation of less than 1% with regard to temperature and build variations. A p-channel JFET 38 acts as a voltage controlled resistor controlled by gate voltage 41, establishing a variable resistance substantially proportional to differential voltage 150. Reference resistor 39 sums with the JFET variable resistance to form a dynamic set point resistance applied to set point input 170. Boost converter 34 increases input voltage 140 greater than the minimum start-up voltage to an output voltage 190 greater than the input voltage 140, employing external charge inductor 36 and output filter capacitor 37. Set point control circuitry within the boost converter 34 applies the dynamic set point resistance occurring at set point input 170, increasing output power instantaneously according the input voltage, relative to the case where the set point resistance is a fixed value. In the unpowered state, the channel resistance of JFET 38 will be much less than reference resistor 39, and thus, reference resistor 39 will substantially establish the minimum start-up voltage for the boost converter 34, and is chosen to either be the smallest operable value for the boost converter 34, or the smallest usable source voltage desired for the TEG, whichever is greater.

Finally, output voltage 190 delivers output power to a low drop out voltage regulator 40 for the purpose of providing a stable output voltage for load 109 after the boost circuit has been fully charged up and turned on.

The above disclosure regarding the second analog implementation of feedforward means shown in FIG. 6 advantageously provides a simple, low-cost analog solution that may be easily integrated into the design of a voltage converter and requiring no programming steps. As indicated above, the results of FIG. 4 show a substantial benefit to implementing the second analog version of the feedforward converter for the thermoelectric energy harvester.

Figure 7:
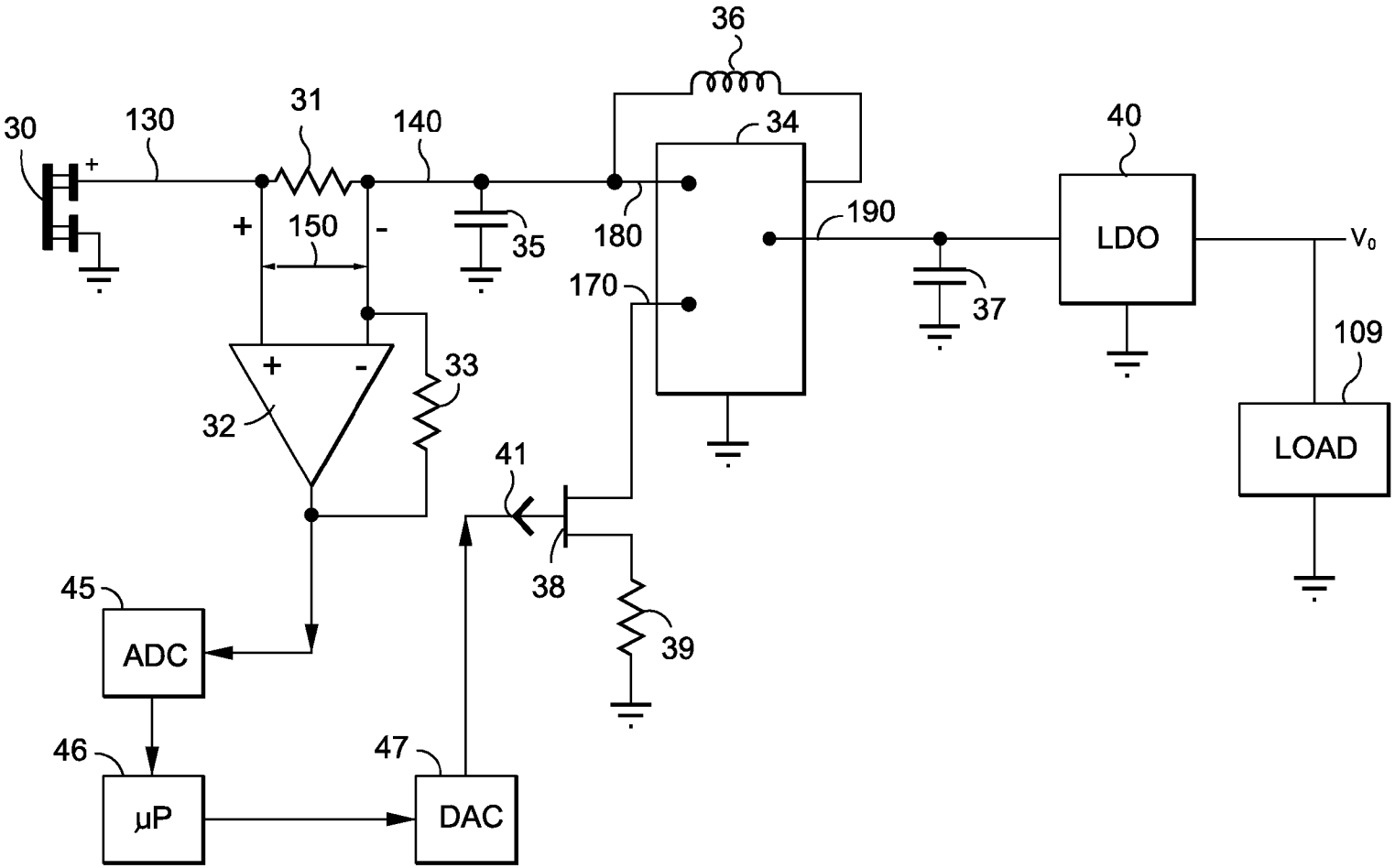
FIG. 7 is a schematic of a first digital embodiment of a feedforward circuit.

Referring to FIG. 7, a first low cost digital implementation of a feedforward means is shown. Thermoelectric generator (TEG) 30 delivers a source voltage 130 to sampling resistor 31, producing input voltage 140, and generating differential voltage 150 between the positive and negative pins of a non-inverting operational amplifier 32. Preferably, sampling resistor 31 is a value much smaller than the input impedance of boost converter 34 so that the input voltage 140 is at least 80% of the source voltage 130. However, larger values for sampling resistor 31 may be necessary if a larger differential voltage 150 is necessary for stable and reliable operation. Capacitor 35 provides input filtering.

Continuing with FIG. 7, non-inverting amplifier 32 amplifies differential voltage 150 by a gain value set by feedback resistor 33 to produce an analog voltage substantially occupying the input operating range of an analog to digital converter (ADC) 45. ADC 45 converts the amplified differential voltage 150 to a digital level, preferably having at least 4 discrete steps, and forwarding the digital level to a microcontroller 46 having been programmed with a lookup table of transformational pairs linking the digital version of differential voltage 150 to a digital version of gate voltage 41. After interpolating the received digital level, microcontroller 46 outputs a digital level to a digital to analog converter 47 (DAC), resulting in an analog gate voltage 41. A p-channel JFET 38 acts as a voltage controlled resistor, controlled by gate voltage 41, establishing a variable resistance substantially proportional to differential voltage 150. Reference resistor 39 sums with the JFET variable resistance to form a dynamic set point resistance applied to set point input 170. Boost converter 34 increases input voltage 140 greater than the minimum start-up voltage to an output voltage 190 greater than the input voltage 140, employing external charge inductor 36 and output filter capacitor 37. Set point control circuitry within the boost converter 34 applies the dynamic set point resistance occurring at set point input 170, increasing output power instantaneously according the input voltage, relative to the case where the set point resistance is a fixed value. In the unpowered state, the channel resistance of JFET 38 will be much less than reference resistor 39, and thus, reference resistor 39 will establish the minimum start-up voltage for the boost converter 34, and is chosen to either be the smallest operable value for the boost converter 34, or the smallest usable source voltage desired for the TEG, whichever is greater.

Finally, output voltage 190 delivers output power to a low drop out voltage regulator 40 for the purpose of providing a stable output voltage for load 109 after the boost circuit has been fully charged up and turned on. The result is a low cost digital implementation of the feedforward means of the thermoelectric energy harvester.

Although a linear transformation of differential voltage 150 is presented herein, it is to be understood that some applications of a thermoelectric energy harvester may require a proportionality having two or more piecewise linear slopes, or even have a non-linear transformation of the differential voltage, in order to compensate for the complex efficiency characteristics of boost circuit 106 occurring at different input voltages. An advantage to a microcontroller implementation of a voltage converter with feedforward means is that multi-slope and non-linear transformations may be more easily realized than by using an analog configuration. To accomplish a non-linear transformation, the lookup table is programmed with pairs of digital levels which correspond to the non-linear transformation that is desired.

Figure 8:
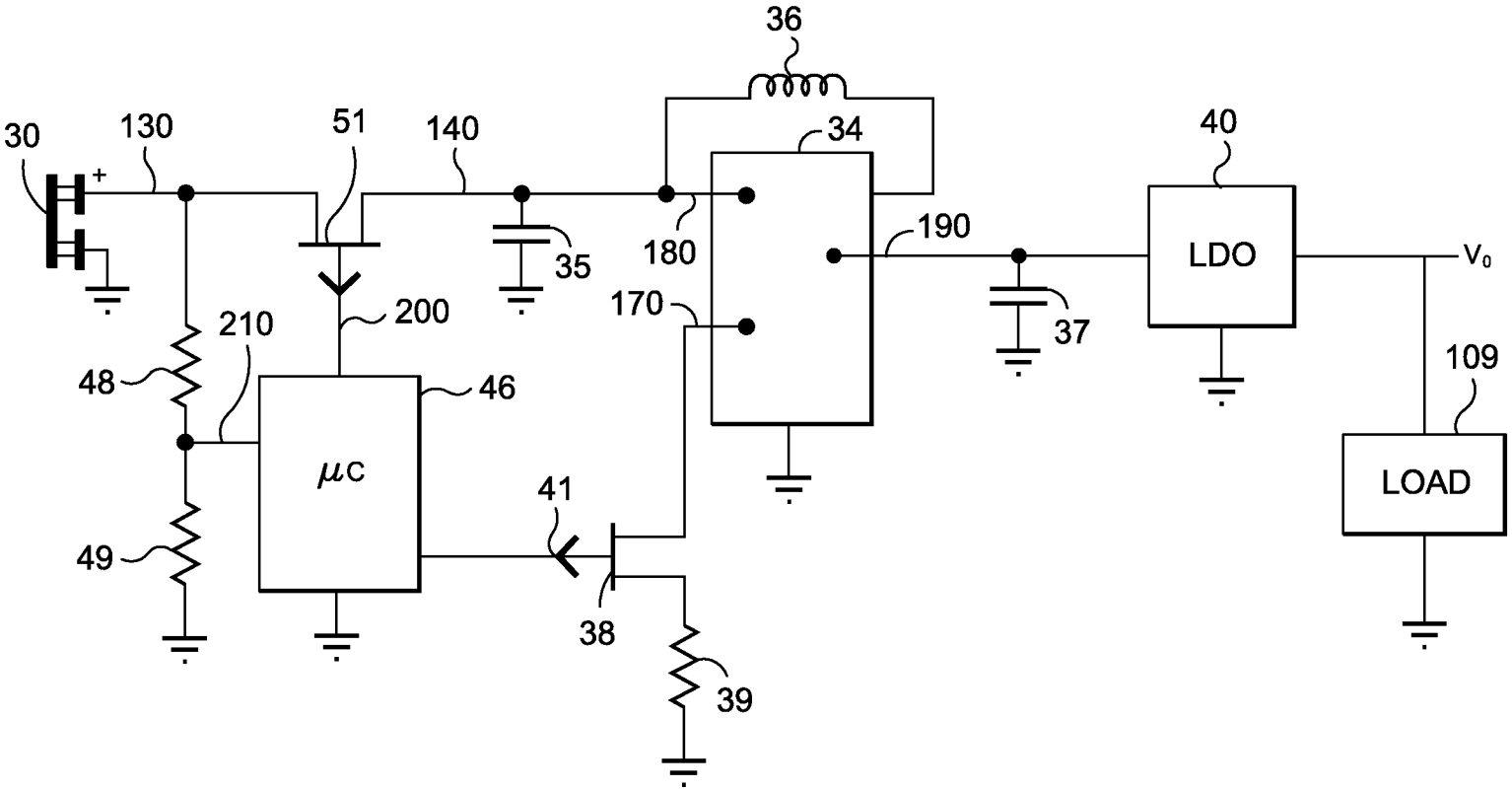
FIG. 8 is a schematic of a second digital embodiment of a feedforward circuit.

Referring to FIG. 8, a second low-cost digital implementation of feedforward means is shown. Thermoelectric generator (TEG) 30 delivers a source voltage 130 to both a boost converter path and a feedforward path. Continuing first with the feedforward path, source voltage 130 connects to sampling resistor 48, forming a voltage divider with grounding resistor 49, and generating fractional voltage 210 which provides a sample of the source voltage to microcontroller 46. TEG 30 may be modeled as an open circuit voltage in series with a source impedance. Open circuit voltage may rise with an increasing temperature difference applied to the TEG 30. The source impedance may change with changes in temperature difference depending on the configuration of the TEG 30, the material system of the TEG 30, and other parameters associated with the TEG 30. When the TEG 30 is properly matched to its load (the boost converter 34), the source voltage 130 may be approximately one-half the open circuit voltage. Each of resistors 48 and 49 preferably are of the same value greater than 100 kΩ, or at least ten times the value of the source impedance, resulting in a fractional voltage 210 that is approximately also one-half the loaded source voltage.

Concerning the boost converter path, switch 51 in its normally ON or closed state connects to source voltage 130 and delivers input voltage 140 to boost converter 34, boost converter 34 having an input impedance which in conventional applications may be configured by a fixed resistor value. Switch 51 may be a p-channel MOSFET having a close-state resistance much smaller than the input impedance of boost converter 34 so that the input voltage 140 is at least 80% of the source voltage 130. MOSFET 51 may have a channel resistance of less than 1Ω at a gate voltage of 0 V, and preferably a resistance of about 200 mΩ or less. Capacitor 35 provides input filtering. Periodically, microcontroller 46 applies a positive gate voltage through sampling control input 200, causing the channel resistance of MOSFET 51 to be substantially greater than the input impedance of the boost converter 34, and resulting in an open circuit condition for TEG 30. Open state channel resistance of MOSFET 51 may preferably be greater than 1 kΩ. During open circuit conditions, the fractional voltage 210 may be about twice the voltage measured when MOSFET 51 is in the closed state, assuming the input impedance of boost converter 34 is approximately equal to the source impedance of TEG 30.

Continuing with FIG. 8, the period with which microcontroller 46 selects an open state for switch 51 may be less than 1% of the time. For example, a 10 ms (millisecond) sample of the open circuit voltage may be collected at fractional voltage input 210 once every 30 seconds. During the remaining time switch 51 is closed and microcontroller 46 collects a long sample of the loaded source voltage at fractional voltage input 210. The ratio of the samples of open circuit voltage to the loaded source voltage may tend to be greater than a factor of 2 when the input impedance of boost converter 34 is lower than the source impedance of TEG 30. And likewise the ratio of the samples of open circuit voltage to the loaded source voltage may tend to be less than a factor of 2 when the input impedance of boost converter 34 is higher than the source impedance of TEG 30.

Therefore, continuing with the feedforward path, it is desirable for microcontroller 46 to increase the input impedance of boost converter 34 as the ratio of open circuit voltage to loaded source voltage increases, and to decrease the input impedance of boost converter 34 as the ratio of open circuit voltage to loaded source voltage decreases. Microcontroller 46 produces a gate voltage 41 which is substantially proportional to the ratio of sampled open circuit voltage to loaded source voltage. A p-channel JFET 38 acts as a voltage controlled resistor, controlled by gate voltage 41, establishing a variable resistance substantially proportional to gate voltage 41. Reference resistor 39 sums with the JFET 38 to form the dynamic set point resistance applied to set point input 170.

Boost converter 34 increases input voltage 140 greater than the minimum start-up voltage to an output voltage 190 greater than the input voltage 140, employing external charge inductor 36 and output filter capacitor 37. Set point control circuitry within the boost converter 34 applies the dynamic set point resistance occurring at set point input 170, increasing instantaneously the power transferred from TEG 30 to boost converter 34 over a wide range of input voltages, relative to the case where the set point resistance is a fixed value. In the unpowered state, the channel resistance of JFET 38 will be much less than reference resistor 39, and thus, reference resistor 39 will establish the minimum start-up voltage for the boost converter 34, and is chosen to either be the smallest operable value for the boost converter 34, or the smallest usable source voltage desired for the TEG, whichever is greater. Output voltage 190 delivers output power to a low drop out voltage regulator 40 for the purpose of providing a stable output voltage for load 109 after the boost circuit has been fully charged up and turned on.

The above disclosure regarding the second digital implementation of the feedforward means provides a simple, low-cost solution that may be easily integrated into a voltage converter. The results of FIG. 4 show the substantial benefit in power efficiency expected by implementing the second digital version of the feedforward converter.

Figure 9:
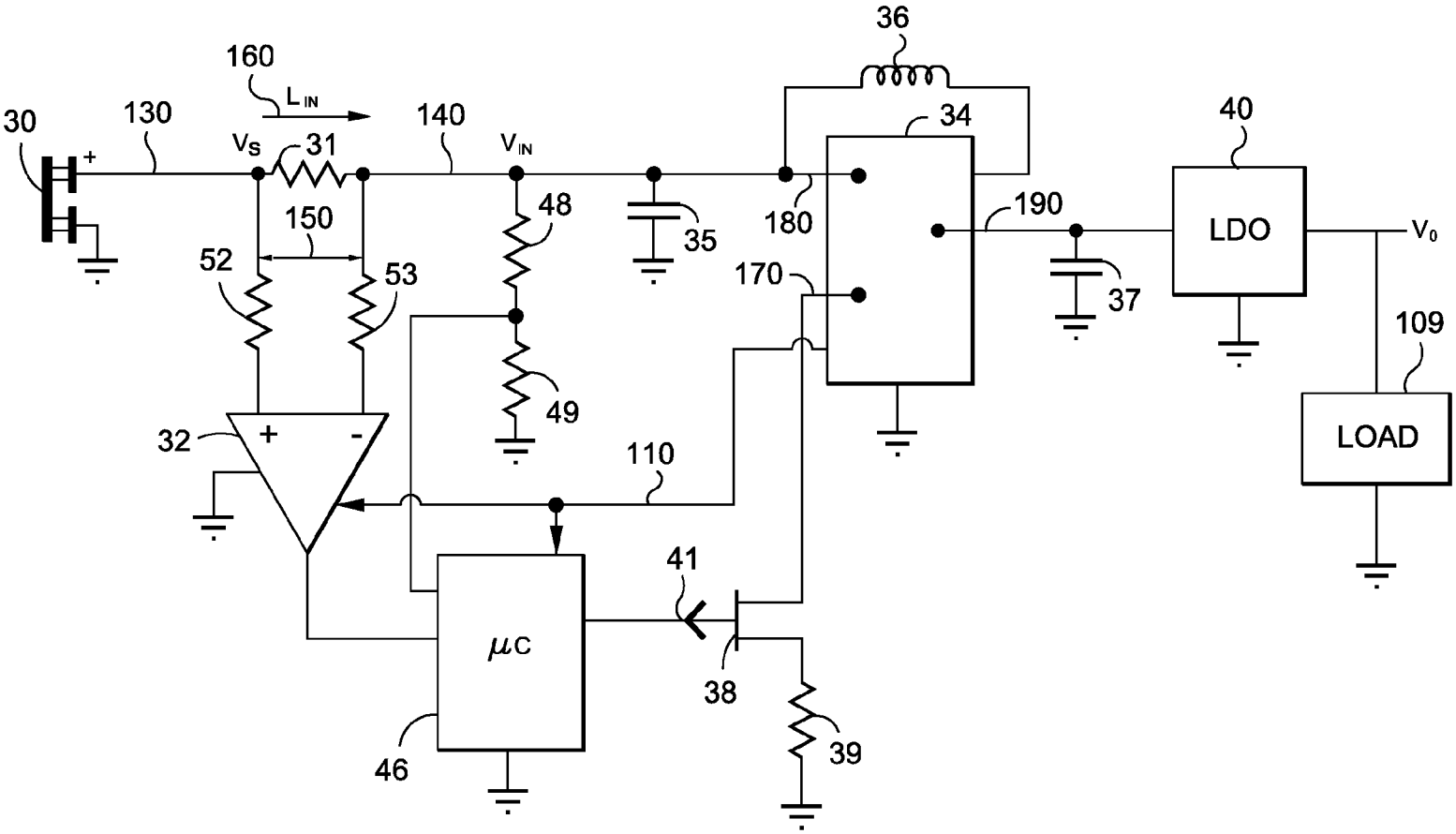
FIG. 9 is a schematic of a third digital embodiment of a feedforward circuit.

Referring to FIG. 9, a third low-cost digital implementation of feedforward means is shown. Thermoelectric generator (TEG) 30 delivers a source voltage 130 that is proportional to a temperature difference provided by the thermal source, the TEG 30 having a power drift over a period of time due primarily to a changing temperature difference. Source voltage 130 connects to sampling resistor 31 which slightly attenuates source voltage 130, leaving input voltage 140 and differential voltage 150. Preferably, sampling resistor 31 may be a value much smaller than the input impedance of boost converter 34 so that the input voltage 140 is at least 80% of the source voltage 130. However, larger values for sampling resistor 31 may be necessary if a larger differential voltage 150 is necessary for stable and reliable operation. Input current 160 may be calculated by dividing differential voltage 150 by sampling resistor 31. Source voltage 130 and input voltage 140 may be applied to operational amplifier 32 through high impedance resistors 52 and 53, respectively, thereby supplying a first analog to digital circuit within microcontroller 46 with a buffered voltage proportional to the input current 160. Input voltage 140 connects to sampling resistor 48, forming a voltage divider with grounding resistor 49, and providing a fractional sample of the input voltage to a second analog to digital converter within microcontroller 46. Each of resistors 48 and 49 preferably are of the same value greater than 100 kΩ, or at least ten times the value of the source impedance, resulting in a voltage divider of typically one-half. Capacitor 35 provides input filtering to input voltage 140, and input voltage 140 connects to boost converter 34 at input pin 180.

Continuing with FIG. 9, microcontroller 46 produces a gate voltage 41 which is iterated to produce dynamic values of resistance at set point input 170, creating a higher input power for the existing TEG operating temperature, relative to using a fixed resistor at set point 170. A p-channel JFET 38 acts as a voltage controlled resistor, controlled by gate voltage 41, establishing a variable resistance substantially proportional to gate voltage 41. Reference resistor 39 sums with the JFET 38 to form the dynamic set point resistance applied to set point input 170.

Microcontroller 46 samples the input voltage 140 through resistors 48 and 49, and calculates input current 160 through the output of operational amplifier 32. Multiplying the input current 160 by input voltage 140 provides a measure of the input power delivered from TEG 30 and into boost converter 34. As the source voltage varies with temperature difference (ΔT), so does the source impedance. As a result, the available input power is not all transferred into the boost converter 34 if the operating point of the boost converter 34 is not adjusted periodically. Generally, for a given source voltage available from TEG 30, the power successfully transferred into the boost converter will be highest for a particular start-up voltage setting, which is often controlled by a fixed resistor, such as the maximum power point control resistor in the LTC3105 converter. At resistor values below this optimum fixed resistor value, power transfer will decline. At resistor values above this optimum fixed resistor value, power transfer will decline. Therefore, by incrementing and decrementing the dynamic set point resistance value and measuring input power in consecutive iterations of the same, a self-optimizing circuit can converge on a maximum power transfer from the TEG 30 to boost converter 34.

Continuing with FIG. 9, an optimization period of time may be divided into a sleep interval and a dwell interval. This period may chosen to be short enough such as to recover a fall in transferred power using small steps that do not overshoot the ideal operating point. Changes in transferred power may occur due to a changing temperature difference surrounding TEG 30 and the resulting impedance mismatch between the TEG 30 and boost converter 34. Additionally, changes may occur due to a drift in the internal circuitry of the boost converter. However, since optimization, occurring during the dwell interval, requires higher microcontroller current drain, the optimization period should not be too short. This period includes a sleep interval which may occupy typically 99% or more of the optimization period. As an example, a period of 30 seconds may be used for the optimization period, with a dwell time of 10 ms.

Figure 10:
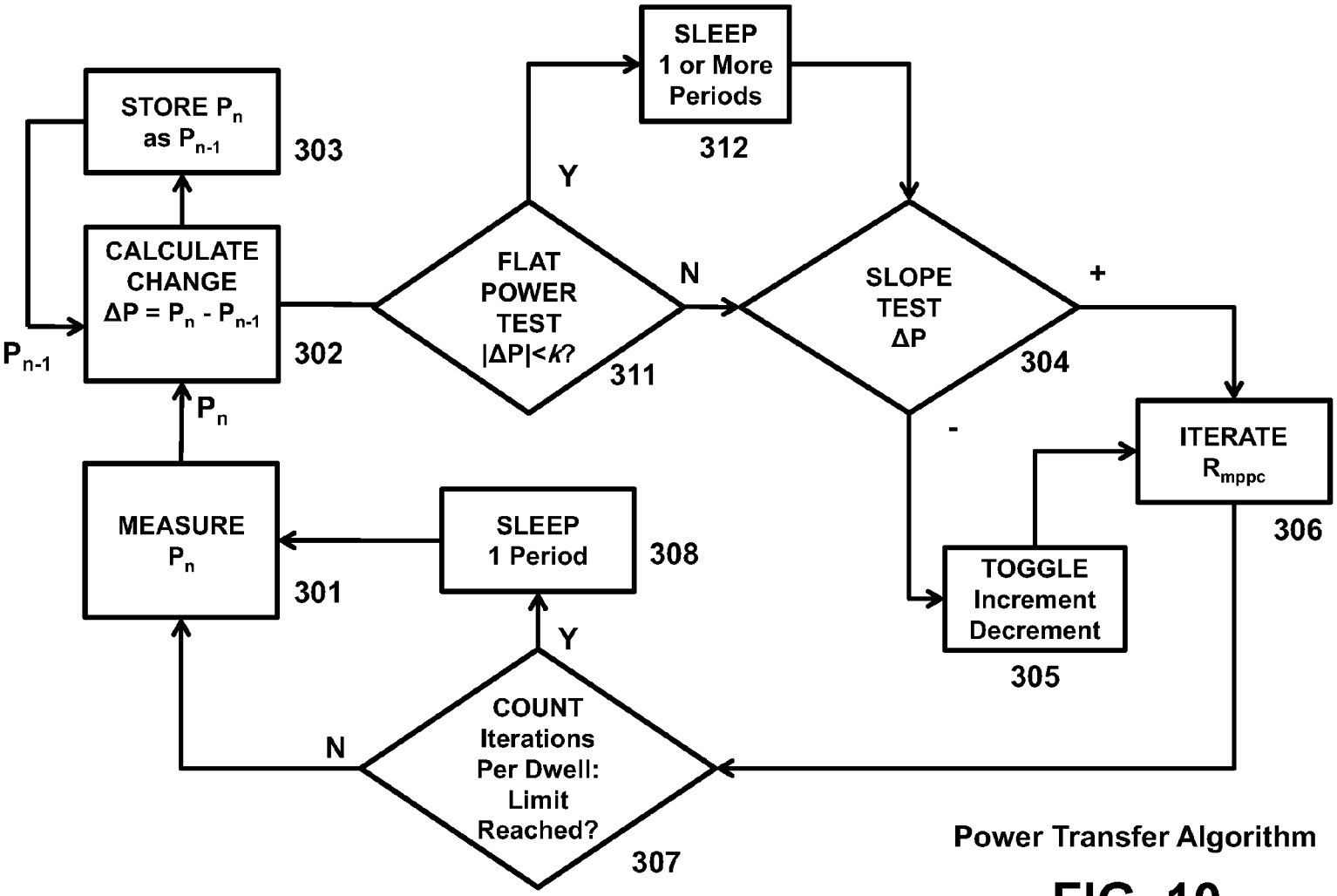
FIG. 10 is a flowchart of optimizing an impedance match.

Referring to FIG. 10 and FIG. 9, the dwell interval is composed of the following steps, which may involve one iteration, or multiple iterations, of setting the dynamic set point resistance. First, arriving out of sleep interval 308, a power measurement 301 is performed, called $P_n$ for the existing value presented to set point input 170. Next, in block 302, the power measurement stored from the preceding measurement using a preceding value presented to set point 170, $P_{n-1}$, is subtracted from $P_n$, yielding ΔP. In block 303, $P_n$ is then stored in a buffer as $P_{n-1}$ for use in the next round. Next, the absolute value of ΔP is tested to see if it is less than a power step indicated as k in block 311, where power step k is set to between zero and a small value substantially less than the power drift being substantially recovered during the optimization period, and k is sufficiently small that power transfer has been optimized and is 'flat'. For a first ΔP-scenario, assume k may be set to zero so that in all cases we pass from block 302 to block 304 unimpeded. In this first ΔP-scenario, each power measurement may be followed immediately by an iteration of set point input 170. In a second ΔP scenario, k can be set to some small non-zero value. If the $|\Delta P|<k$ criteria is met, one or more sleep intervals may be selected prior to beginning the next dwell interval (block 312) since power may already be optimized, thus reducing the power consumed by microcontroller 46. Also, in the event that each dwell interval contains two or more iterations of set point input 170, block 311 facilitates an exit from power-consuming iterations. After one or more periods of sleep mode have occurred, the process resumes with block 304. Power step k may typically be less than 10% over an optimization period.

Continuing on with FIG. 10 and FIG. 9, block 304 tests to see whether power either increased as a result of the latest iteration of set point input 170, or decreased. If the result of the test is positive (power increased), then set point input 170 may be advanced in the same direction as in the last iteration and by an increment substantially comparable to or less than the power drift expected from TEG 30 over an optimization period. If the result of the test in block 304 is negative (power decreased), then the direction of advance for set point input 170 may be reversed by block 305. Block 306 advances the set point input in the same or reversed direction, respectively. Following an iteration, let's consider blocks 307 and 308. In a first count-scenario, if k in block 311 is set to zero, the predetermined count may be set to '1' or a small number (block 307) in order to limit the number of power-consuming iterations that occur within any dwell interval. Once the predetermined count has been reached within that dwell interval, a sleep interval 308 occurs lasting approximately one optimization period. Waking up out of block 308, the process begins again. In a second count-scenario, if the count on block 307 is set to a large number, the optimization circuitry may converge quickly on a maximum power transfer. In this case, it may be desirable to set k in block 311 to a value larger than the smallest ΔP encountered during the dwell interval in order to 'kick out' the iteration process with a sleep mode in block 312.

Boost converter 34 increases input voltage 140 greater than the minimum start-up voltage to an output voltage 190 greater than the input voltage 140, employing external charge inductor 36 and output filter capacitor 37. Set point control circuitry within the boost converter 34 applies the dynamic set point resistance occurring at set point input 170, increasing the power transferred from TEG 30 to boost converter 34 for each input voltage and over a wide range of input voltages, relative to the case where the set point resistance is a fixed value. In the unpowered state, the channel resistance of JFET 38 will be much less than reference resistor 39, and thus, reference resistor 39 will establish the minimum start-up voltage for the boost converter 34, and is chosen to either be the smallest operable value for the boost converter 34, or the smallest usable source voltage desired for the TEG, whichever is greater. Output voltage 190 delivers output power to a low drop out voltage regulator 40 for the purpose of providing a stable output voltage for load 109 after the boost circuit has been fully charged up and turned on.

The turn-on sequence of the energy harvester, including microcontroller 46 and operational amplifier 32, is as follows. Once TEG 30 is generating enough power that input voltage 140 exceeds the minimum start-up voltage, boost converter 34 begins to charge up and eventually can supply a regulated supply voltage 110 to microcontroller 46 and operational amplifier 32, in addition to supplying circuitry internal to boost converter 34. As input voltage rises above the minimum start-up voltage, microcontroller 46 iterates the signal presented to set point input 170 based on measurements of input power changes, thus increasing the power transferred from TEG 30 to boost converter 34 for a given temperature difference, as a result increasing the output power delivered to load 109, relative to using a fixed resistance.

As an example of the digital implementation of the feedforward means, an ultra-low-power microcontroller designated as the MSP430, commercially available from Texas Instruments of Dallas, Tex., is used for managing power consumption in wireless sensor applications. With a low power consumption of typically 270 micro-amps (μA) at 2.2 V, or about 0.6 milliwatts (mW), the MSP430 microcontroller removes a modest portion of the power produced by a typical micro-energy harvester, or about 6% of a harvester producing 10 mW of power. With adequate random access memory and a built in ADC, the MSP430 microcontroller could be part of an integrated converter solution delivering high dynamic range for a TEG energy harvester.

Also, it is to be understood that a dynamic set point voltage may be applied to set point input 170, eliminating JFET 38, instead of a dynamic set point resistance, for applications where the boost converter 34 benefits from a voltage input instead of a resistive input.

Advantageously, several solutions to TEG micro-energy harvesters with high efficiency over a limited range of input voltages are disclosed herein. Feedforward transformations are preferably linear, but may also be non-linear or two or more piecewise linear slopes, possibly resulting in more precise optimization of the boost circuit. The disclosure presents a solution to the case where boost-style voltage converters having a set point input for adjusting start-up voltage may be configured to create a dynamic solution. It is to be understood that the general case of a voltage converter have a resistive adjustment for optimum input voltage is configurable to the solution herein disclosed. Also, it is to be understood that the case of using iterations of an operating point based on measurements of input power may be applied to voltage converters having means of adjusting their operating point other than by their start-up voltage.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A self-optimizing energy harvester for powering a load, comprising:

a thermoelectric generator coupling to a heat source and a heat sink and producing a source voltage that is proportional to a temperature difference between the heat source and the heat sink;

a sampling means attenuating said source voltage and leaving an input voltage;

a feedforward means receiving said source voltage and said input voltage and processing a resulting differential voltage, the feedforward means generating a variable resistance and a reference resistance being summed to form a dynamic set point resistance, the variable resistance being proportional to said differential voltage, and the reference resistance for setting a minimum start-up voltage, said processing performing at least one of the following: buffering, amplifying, level shifting, digitizing, storing, and analog recovery;

a boost circuit coupling to said input voltage larger than the minimum start-up voltage and generating an output voltage generally larger than the input voltage, the boost circuit having a maximum output power only according to the input voltage for which it is configured; and a set point control means being coupled to the boost circuit and to the feedforward means, said set point control means instantaneously configuring the boost circuit for increased output power for each occurring input voltage by using the dynamic set point resistance relative to using a fixed resistance, the boost circuit delivering the output power to the load.

2. The energy harvester of claim 1, wherein said feedforward means is performed by a microcontroller, the microcontroller controlling a variable controlled resistance for establishing a variable resistance proportional to said differential voltage.

3. The energy harvester of claim 1, further comprising a low drop out voltage regulator, wherein said output voltage is coupled to the low drop out voltage regulator, said regulator delivering power to the load.

4. The energy harvester of claim 1, wherein said proportionality between said variable resistance and said differential voltage is optimized for maximum power transfer from the thermoelectric generator to the boost circuit.

5. The energy harvester of claim 1, further comprising a continuous range of input voltages within which output power efficiency is greater than 80%, the continuous range of input voltages lying between a minimum input voltage and a maximum input voltage, wherein a ratio of the maximum input voltage to the minimum input voltage increases by at least 20% relative to using said fixed resistance.

6. The energy harvester of claim 1, wherein the minimum start-up voltage is reduced by at least 20% without sacrificing output power at higher input voltages, relative to using a fixed resistance.

7. The energy harvester of claim 1, wherein said input voltage is at least approximately 80% of the source voltage.

8. A self-optimizing energy harvester for powering a load, comprising:

a thermoelectric generator coupling to a heat source and a heat sink and producing a source voltage that is proportional to a temperature difference between the heat source and the heat sink, the thermoelectric generator having a source impedance being associated with the temperature difference;

a resistive divider conducting said source voltage to ground and providing a fractional voltage less than the source voltage at a junction between a first resistance and a second resistance summing to form the resistive divider;

a switching means having a normally closed state receiving said source voltage and providing an input voltage substantially equivalent to the source voltage, said switching means also having a selectable open state disconnecting the thermoelectric generator from the input voltage and producing an open circuit voltage, said selection being effected by a sampling control input;

a microcontroller coupling to said sampling control input and generating a gate voltage, said microcontroller receiving said fractional voltages during the normally closed state and during a periodically selected said open state and thereupon calculating a voltage ratio of the open circuit voltage to the source voltage, said gate voltage being set substantially proportional to said voltage ratio;

a voltage controlled resistor receiving said gate voltage at a gate terminal;

a reference resistor connecting in series with the voltage controlled resistor to form a dynamic set point resistance electrically grounded at one end, the dynamic set point resistance having an off-state resistance establishing a minimum start-up voltage for the energy harvester;

a boost circuit coupling to said input voltage larger than the minimum start-up voltage and generating an output voltage generally larger than the input voltage, the boost circuit having an input impedance according to the minimum start-up voltage for which it is configured; and a set point control means being coupled to the boost circuit and to the dynamic set point resistance, said set point control means instantaneously configuring the boost circuit for an increased power transfer between the thermoelectric generator and the boost circuit for each occurring said input impedance and said source impedance by using the dynamic set point resistance relative to using a fixed resistance, the boost circuit delivering an output power to the load.

9. The energy harvester of claim 8, further comprising a low drop out voltage regulator, wherein said output voltage is coupled to the low drop out voltage regulator, said regulator delivering power to the load.

10. The energy harvester of claim 8, wherein said periodically selected open state occurs less than 1% of the time.

11. The energy harvester of claim 8, wherein said first resistance and said second resistance are substantially equal.

12. A self-optimizing energy harvester for powering a load, comprising:

a thermoelectric generator coupling to a heat source and a heat sink and producing a source voltage that is proportional to a temperature difference between the heat source and the heat sink;

a sampling means attenuating said source voltage and leaving an input voltage;

a differential amplifier receiving said source voltage and said input voltage and amplifying a resulting differential voltage to generate a gate voltage which is proportional to the differential voltage;

a voltage controlled resistor receiving said gate voltage at a gate terminal, thereby establishing a voltage controlled resistance proportional to said differential voltage;

a reference resistor connecting in series with the voltage controlled resistor to form a dynamic set point resistance electrically grounded at one end, the dynamic set point resistance having an off-state resistance establishing a minimum start-up voltage for the energy harvester;

a boost circuit coupling to said input voltage larger than the minimum start-up voltage and generating an output voltage generally larger than the input voltage, the boost circuit having a maximum output power only at the input voltage for which it is configured; and a set point control means being coupled to the boost circuit and to the dynamic set point resistance, said set point control means instantaneously configuring the boost circuit for maximum output power for each occurring input voltage larger than the minimum start-up voltage and according to the dynamic set point resistance, thereby increasing the output power for a range of input voltages by using a dynamic set point resistance relative to using a fixed resistance, the boost circuit delivering an output power to the load.

13. The energy harvester of claim 12, further comprising a low drop out voltage regulator, wherein said output voltage is coupled to the low drop out voltage regulator, said regulator delivering power to the load.

14. The energy harvester of claim 12, wherein said proportionality between said gate voltage and said differential voltage is optimized for maximum power transfer from the thermoelectric generator to the boost circuit.

15. The energy harvester of claim 12, wherein said differential amplifier is comprised of at least two concatenated amplifiers, a gain of the differential amplifier varying less than 1% over temperature and build variations relative to a design point.

16. The energy harvester of claim 12, further comprising a continuous range of input voltages within which output power efficiency is greater than 80%, the continuous range of input voltages lying between a minimum input voltage and a maximum input voltage, wherein a ratio of the maximum input voltage to the minimum input voltage increases by at least 20% relative to using said fixed resistance.

17. The energy harvester of claim 12, wherein the minimum start-up voltage is reduced by at least 20% without sacrificing output power at higher input voltages, relative to using a fixed resistance.

18. The energy harvester of claim 12, wherein said input voltage is at least approximately 80% of the source voltage.

19. A self-optimizing energy harvester for powering a load, comprising:

a thermoelectric generator coupling to a heat source and a heat sink and producing a source voltage that is proportional to a temperature difference between the heat source and the heat sink, said thermoelectric generator having a power drift over a period of time;

a sampling resistor attenuating said source voltage and leaving an input voltage;

a differential amplifier receiving said source voltage and said input voltage and amplifying a resulting differential voltage to generate a buffered output which is proportional to an input current calculated by dividing said differential voltage by said sampling resistor;

a resistive divider conducting the input voltage to ground and providing a fractional voltage proportional to the input voltage at a junction between a first resistance and a second resistance summing to form the resistive divider;

a voltage controlled resistor having a gate terminal;

a reference resistor connecting in series with the voltage controlled resistor to form a dynamic set point resistance electrically grounded at one end, the dynamic set point resistance having an off-state resistance establishing a minimum start-up voltage for the energy harvester;

a microcontroller coupling to said gate terminal and calculating an input power during said period of time, said input power being proportional to a product of said fractional voltage and said buffered output, the period of time comprising a dwell interval followed by a sleep interval, the microcontroller drawing substantially lower current during said sleep interval occupying a substantial majority of the period of time, the microcontroller performing the following during the dwell interval:

measuring said input power for an existing value of the dynamic set point resistance, calculating a power change by subtracting an input power for a preceding value of the dynamic set point resistance from the input power for the existing value of the dynamic set point resistance, iterating the dynamic set point resistance by an amount substantially causing an increase in the input power during the dwell interval, said increase in the input power being substantially equal to said power drift occurring in the thermoelectric generator over said period of time, a boost circuit coupling to said input voltage larger than the minimum start-up voltage and generating an output voltage generally larger than the input voltage, the boost circuit having an input impedance according to the minimum start-up voltage for which it is configured; and a set point control means being coupled to the boost circuit and to the dynamic set point resistance, said set point control means continuously configuring the boost circuit for increasing input power from the thermoelectric generator and into the boost circuit for each occurring said dwell interval by using the dynamic set point resistance relative to using a fixed resistance, the boost circuit delivering an output power to the load.

20. The energy harvester of claim 19, further comprising comparing an absolute value of said power change to a power step substantially smaller than said power drift, said comparing followed by entering the sleep interval for as least one said period of time if the power change is less than said power step.

21. The energy harvester of claim 19, further comprising counting up to a predetermined number of iterations of the dynamic set point resistance, said predetermined number occurring within the dwell interval, the predetermined number forcing an end to the dwell interval having higher power consumption, and quickening the maximizing of power delivered to the load, the predetermined number being followed by the sleep interval.

22. The energy harvester of claim 19, further comprising a low drop out voltage regulator, wherein said output voltage is coupled to the low drop out voltage regulator, said regulator delivering power to the load.

23. The energy harvester of claim 19, further comprising a continuous range of input voltages within which output power efficiency is greater than 80%, the continuous range of input voltages lying between a minimum input voltage and a maximum input voltage, wherein a ratio of the maximum input voltage to the minimum input voltage increases by at least 20% relative to using said fixed resistance.

24. The energy harvester of claim 19, wherein the minimum start-up voltage is reduced by at least 20% without sacrificing output power at higher input voltages, relative to using a fixed resistance.

25. The energy harvester of claim 19, wherein the power step is less than 10% of the input power.

26. A method for harvesting thermoelectric energy and supplying a load, comprising the steps of:

coupling a thermoelectric generator to a heat source and a heat sink having a temperature difference therebetween;

converting said temperature difference into a source voltage proportional to said temperature difference;

attenuating said source voltage to produce an input voltage which is at least 80% of the source voltage;

subtracting said input voltage from said source voltage to produce a differential voltage;

processing said differential voltage and thereby generating a variable resistance and a reference resistance summing to form a dynamic set point resistance, the variable resistance being proportional to said differential voltage, and the reference resistance setting a minimum start-up voltage, said processing including performing at least one of the following: buffering, amplifying, level shifting, digitizing, storing, and analog recovering;

boosting said input voltage larger than the minimum start-up voltage and generating an output voltage larger than the input voltage, and maximizing output power only at the input voltage for which it is configured; and configuring the output power at each occurring input voltage larger than the minimum start-up voltage and according to the dynamic set point resistance, thereby increasing the output power for a range of input voltages by using a dynamic set point resistance relative to using a fixed resistance.

27. The method of claim 26, further including the step of coupling said output voltage to a low drop out voltage regulator.

28. The method of claim 26, further including the step of powering a load from said output voltage.

29. The method of claim 26, wherein said proportionality between said variable resistance and said differential voltage is optimizing for maximum power transfer from the thermoelectric generator to said output power.

30. The method of claim 26, further comprising a continuous range of input voltages within which output power efficiency is greater than 80%, the continuous range of input voltages lying between a minimum input voltage and a maximum input voltage, wherein a ratio of the maximum input voltage to the minimum input voltage increases by at least 20% relative to using said fixed resistance.

31. The method of claim 26, wherein the minimum start-up voltage reducing by at least 20% without sacrificing output power at higher input voltages, relative to using said fixed resistance.

* * * * *